US006132114A

United States Patent [19]

Aso et al.

[11] Patent Number: 6,132,114

[45] Date of Patent: Oct. 17, 2000

[54] REPLENISHER SUPPLY DEVICE FOR PHOTOSENSITIVE MATERIAL PROCESSOR

[75] Inventors: Toru Aso; Tetsuya Ishizuka, both of Kanagawa, Japan

[73] Assignee: Fuji Photo Film Co., Ltd., Kanagawa, Japan

[21] Appl. No.: 09/323,117

[22] Filed: Jun. 1, 1999

[30] Foreign Application Priority Data

Jun. 1, 1998 [JP] Japan ..... 10-151683

[51] Int. Cl.[7] ..... G03D 3/02

[52] U.S. Cl. ..... 396/626

[58] Field of Search ..... 396/598, 599, 396/626, 636

[56] References Cited

U.S. PATENT DOCUMENTS 5,307,107 4/1994 Nozawa et al. ..... 396/626
5,432,583 7/1995 Ishikawa et al. ..... 396/626
5,491,530 2/1996 Earle et al. ..... 396/626
5,765,071 6/1998 Kinoshita et al. ..... 396/626
5,930,550 7/1999 Tanaka ..... 396/626

*Primary Examiner*—D. Rutledge
*Attorney, Agent, or Firm*—Sughrue, Mion, Zinn, Macpeak & Seas, PLLC

[57] ABSTRACT

A photo film processor has a bath component, which contains processing liquid and processes photo film by use of the processing liquid. A processor body contains the bath component. A replenisher supply device has two cartridge holders loadable with two replenisher cartridges, which contain replenisher liquid for adjustment of the processing liquid. Two tanks store the replenisher liquid having flowed out of the replenisher cartridges. A maintenance opening is formed in the processor body. A panel is secured to the maintenance opening movably between closed and open positions. On the panel, the cartridge holders and the tanks are mounted. The panel, when in the closed position, closes the maintenance opening, and when in the open position, is positioned outside the maintenance opening, for allowing inspection and/or maintenance of the bath component.

18 Claims, 7 Drawing Sheets

REPLENISHER SUPPLY DEVICE FOR PHOTOSENSITIVE MATERIAL PROCESSOR

BACKGROUND OF THE INVENTION

1. Field of the Invention

The present invention relates to a replenisher supply device for a photosensitive material processor. More particularly, the present invention relates to a replenisher supply device capable of facilitating inspection and/or maintenance of a photosensitive material processor associated therewith.

2. Description Related to the Prior Art

There are various automatic photosensitive material processors including a photo film processor and a printer/processor. The photosensitive material processor of any type photographically develops photosensitive material, such as photo film and color photographic paper. The photo film processor automatically develops photo film. The printer/processor includes a printer section in which images on developed photo film are printed on color paper, and a processor section for automatically developing the color paper. The photosensitive material processor includes a series of plural processing baths, each of which contains processing liquids, either solution or water, for color development, bleaching, fixation, water washing and stabilization, and through which the photo film or color paper is moved sequentially. In the processing baths, the processing liquids change in the amount or composite in the course of processing of the photo film or color paper. Thus, replenisher tanks are disposed for supplementing the replenisher liquids according to the amount of the processing.

An easily insertable replenisher cartridge has been known recently, and is preferred to be used in the photosensitive material processor in concealing dirty and non-agreeable impression of the replenisher liquids. The use of the replenisher cartridge makes it possible in the photosensitive material processor to supply the replenisher tanks automatically with the replenisher liquids. Contamination of operators' clothes with the replenisher liquids, and other accidents can be prevented.

The photosensitive material processor of such a type is provided with a replenisher supply device disposed on its lateral side in view of reducing its size. The whole of the one lateral face of the series of the processing baths is covered by the replenisher supply device. When an operator desires to inspect pumps or the like disposed with the processing baths or near to them for the purpose of maintenance, the disposition of the replenisher supply device does not provide a space sufficient to allow the operator easily to inspect the processor. The efficiency in the inspection and/or maintenance has not been high.

SUMMARY OF THE INVENTION

In view of the foregoing problems, an object of the present invention is to provide a replenisher supply device for a photosensitive material processor, in which the inspection and/or maintenance of the processor can be facilitated.

In order to achieve the above and other objects and advantages of this invention, a replenisher supply device is for use with a photosensitive material processor. In the photosensitive material processor, a bath component contains processing liquid and processes photosensitive material by use of the processing liquid. A processor body contains the bath component. In the replenisher supply device, at least one cartridge holder is loadable with at least one replenisher cartridge, wherein the replenisher cartridge contains replenisher material for adjustment of the processing liquid. At least one tank stores the replenisher material having flowed out of the replenisher cartridge. A maintenance opening is formed in the processor body. A panel is secured to the maintenance opening movably between closed and open positions. On the panel, the cartridge holder and the tank are mounted. The panel, when in the closed position, closes the maintenance opening, and when in the open position, is positioned outside the maintenance opening, for allowing inspection and/or maintenance of the bath component.

According to the present invention inspection and/or maintenance of the processor can be facilitated, because the panel can come to the open position to move the cartridge holder and the tank away from various parts of the photosensitive material processor.

Furthermore, at least one cartridge opener is mounted on the panel, for opening the replenisher cartridge set in the cartridge holder, for flowing of the replenisher material.

The replenisher cartridge includes a cartridge body having a cartridge exit at one end thereof, for containing the replenisher material. A sealing member closes the cartridge exit. The cartridge opener opens the sealing member.

The cartridge opener is disposed under the cartridge holder, and the tank is disposed under the cartridge opener.

Furthermore, a hinge connector connects the panel with the maintenance opening in a pivotally movable manner.

The sealing member comprises a film or sheet. The cartridge opener includes an opener punch, disposed on an extension of the cartridge exit away from the cartridge body, for breaking open the sealing member. A shifter shifts one of the opener punch and the replenisher cartridge toward another thereof, to push the opener punch into the sealing member.

The shifter shifts the replenisher cartridge by shifting the cartridge holder.

Furthermore, a connector pipe introduces the replenisher material from the cartridge exit to the tank. A funnel member is disposed about the opener punch, for avoiding leaking of the replenisher material between the cartridge exit and the connector pipe.

The cartridge opener further includes a liquid supply nozzle, disposed in the opener punch, for supplying the replenisher cartridge with liquid, to wash the replenisher cartridge and/or to dilute the replenisher material.

The cartridge holder includes a holder chamber for containing the replenisher cartridge. A cartridge positioning gap is formed in a bottom of the holder chamber, for positioning the cartridge exit downwards by receiving insertion of the end of the cartridge body.

The cartridge holder further includes a holder opening, formed in the panel, for externally uncovering the holder chamber. A holder lid closes the holder opening openably.

The at least one replenisher cartridge is at least three replenisher cartridges arranged in one predetermined direction and positioned within the cartridge holder. The at least one cartridge opener is at least three cartridge openers arranged in the predetermined direction. The at least one tank is at least three tanks arranged in the predetermined direction.

In a preferred embodiment, the at least one replenisher cartridge is plural replenisher cartridges. The at least one cartridge holder is loadable with at least one replenisher cartridge kit. The replenisher cartridge kit includes the plural replenisher cartridges. A casing contains the plural replenisher cartridges. An opening is formed in the casing, for positioning the cartridge exit outside the casing by receiving insertion of the end of the cartridge body.

The at least one replenisher cartridge kit is two replenisher cartridge kits. The at least one cartridge holder is two cartridge holders arranged in one predetermined direction. The plural replenisher cartridges are arranged in the predetermined direction and positioned within each of the two cartridge holders.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1A:
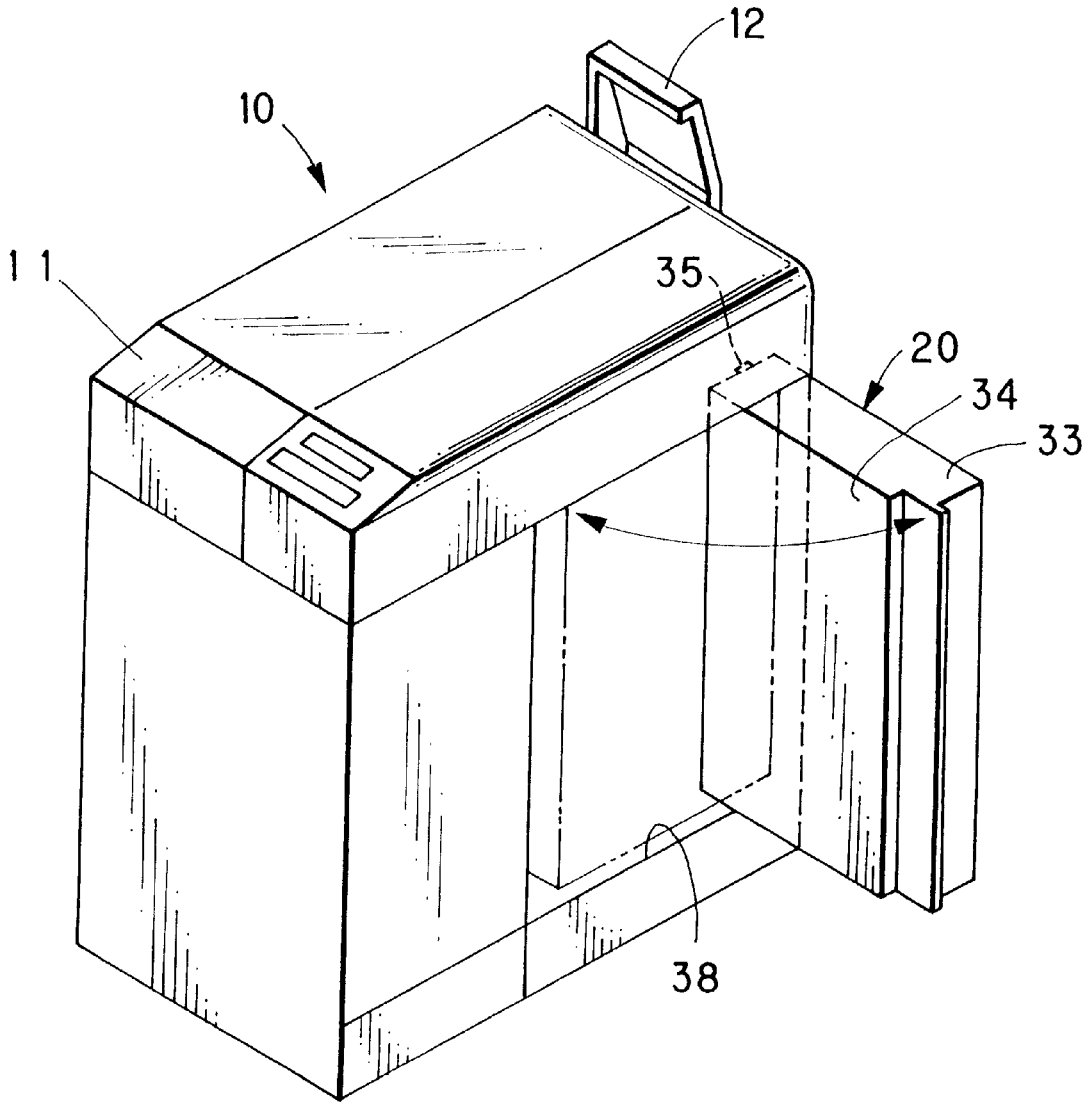
FIG. 1A is a perspective illustrating a photo film processor with a replenisher supply device.
Figure 1B:
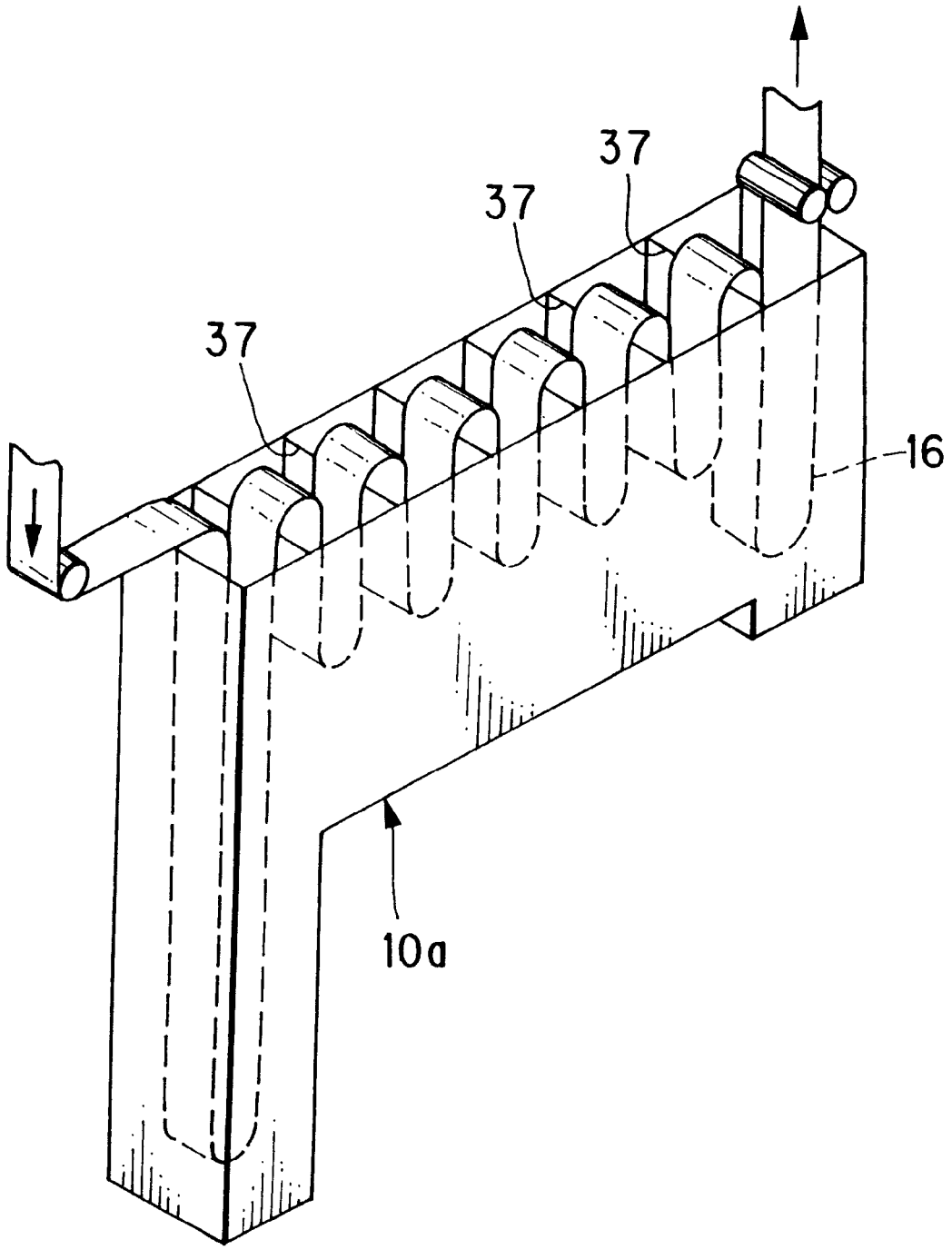
FIG. 1B is an explanatory view in perspective, illustrating a bath component of the photo film processor.

In FIGS. 1A and 1B, a photo film processor 10 is generally depicted. The photo film processor 10 has a bath component 10*a* which consists of a well-known set of plural processing baths 37 including a color developing bath, a bleaching bath, a bleaching/fixing bath, a super rinsing bath and a stabilizing bath, and also the photo film processor 10 has a drying section. A photo film loading station 11 is loaded with photo film 16, which is passed to be processed for development through processing liquids, either solution or water, in the various processing baths 37 and through the drying section. After the processing, the photo film 16 is suspended by a photo film reservoir 12 in a collective manner.

Figure 2:
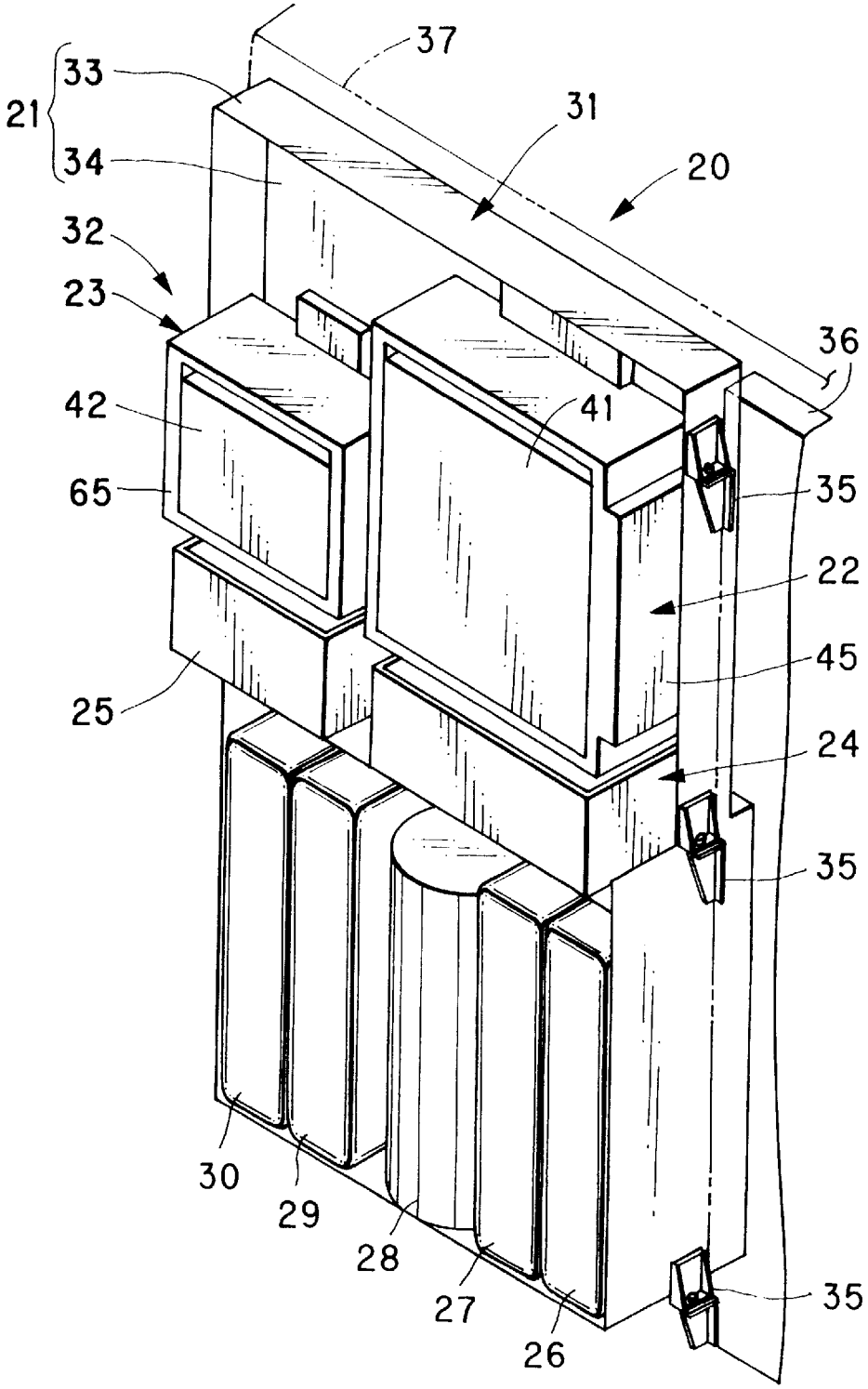
FIG. 2 is a perspective illustrating the replenisher supply device.
Figure 3:
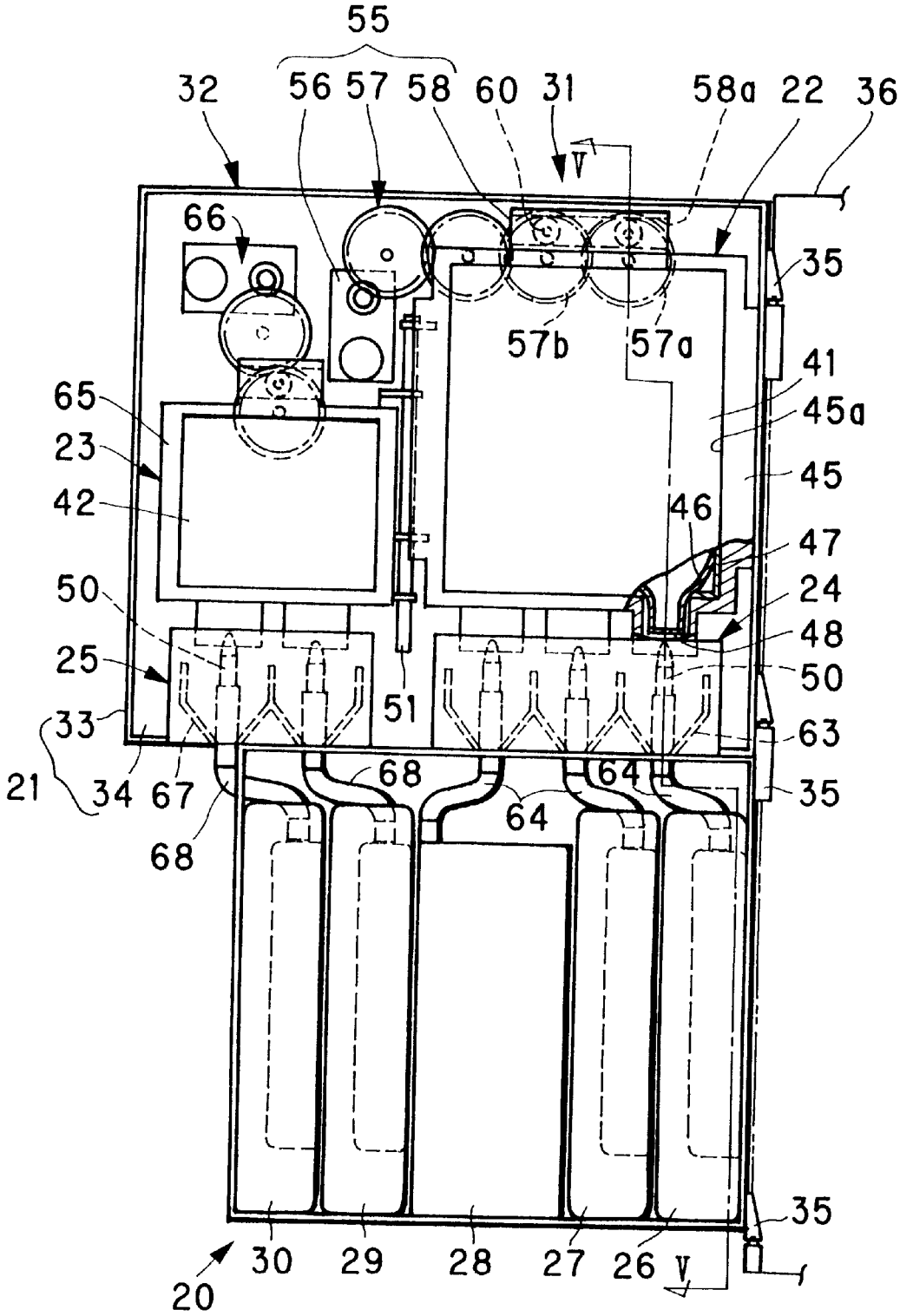
FIG. 3 is a front elevation illustrating the replenisher supply device.

A replenisher supply device 20 is disposed on a lateral side of the processing baths 37 and the drying section. In FIGS. 2 and 3, the replenisher supply device 20 is constituted by a panel unit or support unit 21 and various parts mounted thereon, including cartridge holders or bottle kit holders 22 and 23, cartridge openers 24 and 25 and tanks 26, 27, 28, 29 and 30. The replenisher supply device 20 consists in a combination of first and second supplier components 31 and 32. The first supplier component 31 includes the cartridge holder 22, the cartridge opener 24 and the tanks 26–28, and operates for supply of the replenisher liquids into the bleaching/fixing bath, the super rinsing bath and the stabilizing bath for the downstream processing. The second supplier component 32 includes the cartridge holder 23, the cartridge opener 25 and the tanks 29 and 30, and operates for supply of the replenisher liquids into the color developing bath, the bleaching bath for the upstream processing.

The panel unit 21 is constituted by a frame 33 and a securing panel 34. A hinge connector 35 connects the panel unit 21 to a processor body or chassis 36 of the photo film processor 10, and keeps the panel unit 21 pivotally movable between a closed position of FIG. 2 the nearest to the processing baths 37 and an open position of FIG. 1A where the panel unit 21 is wide open at an angle of 90 degrees from the closed position in a counterclockwise direction. In the open position, the replenisher supply device 20 is away from the processing baths 37, so as to open a maintenance opening 38. The maintenance opening 38 makes it easy to inspect the processing baths 37, the drying section and pumps, which are portions of the bath component 10*a* inside the processor body 36.

Figure 4:
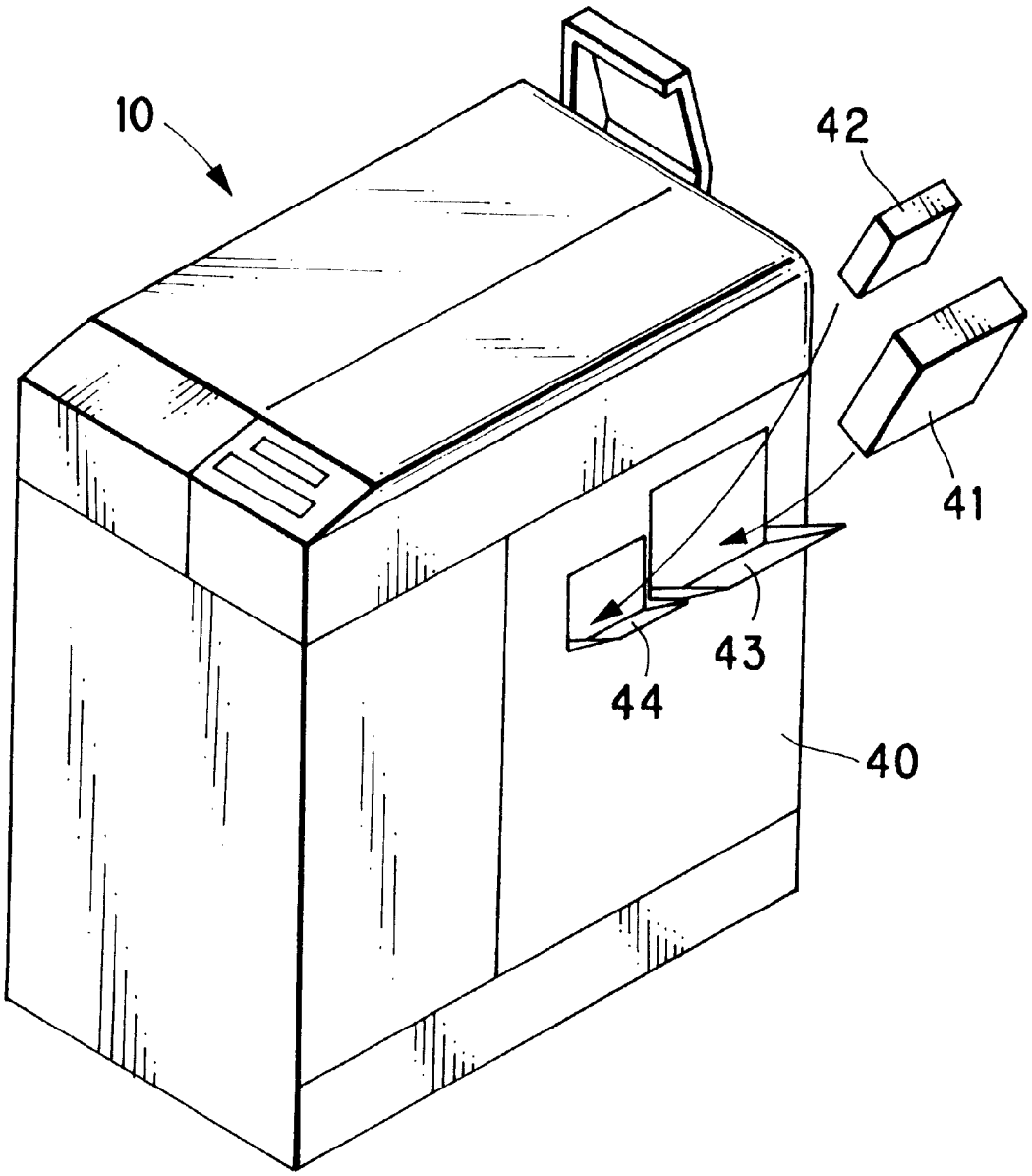
FIG. 4 is a perspective illustrating the photo film processor.

The panel unit 21 is retained in the closed position by fixing screws when in a normal state for being used. In FIG. 4, an outer panel 40 is secured by screws to cover the replenisher supply device 20 while retained in the closed position. Two holder lids 43 and 44 are mounted in the outer panel 40 in an openable manner, and adapted to setting of replenisher cartridge kits or replenisher bottle kits 41 and 42. When the holder lids 43 and 44 are opened, the replenisher cartridge kits 41 and 42 can be set easily into the replenisher supply device 20.

In FIG. 3, the first supplier component 31 is constituted by the cartridge holder 22, the cartridge opener 24 and the tanks 26–28. The cartridge holder 22 consists of a cartridge holder frame or bottle kit holder frame 45. A holder chamber 45*a* of the cartridge holder frame 45 is formed for containing the replenisher cartridge kit 41, and has a cartridge positioning gap, disposed at a bottom, for retaining the replenisher cartridge kit 41.

Three replenisher cartridges or replenisher bottles 46 are included in the replenisher cartridge kit 41, which has a casing 47 for packaging those. Cartridge exits of the replenisher cartridges 46 are located outside the casing 47, and closed by sheet-shaped sealing members 48. An opener punch 50, to be described later, pushes open each of the sealing members 48 to unstop the cartridge exits of the replenisher cartridges 46.

A guiding rod 51 is disposed to be oriented vertically, and supports the cartridge holder frame 45 in a vertically movable manner with respect to the panel unit 21. A shifter mechanism 55 is connected with the cartridge holder frame 45, and shifts the cartridge holder frame 45 up and down.

Figure 5:
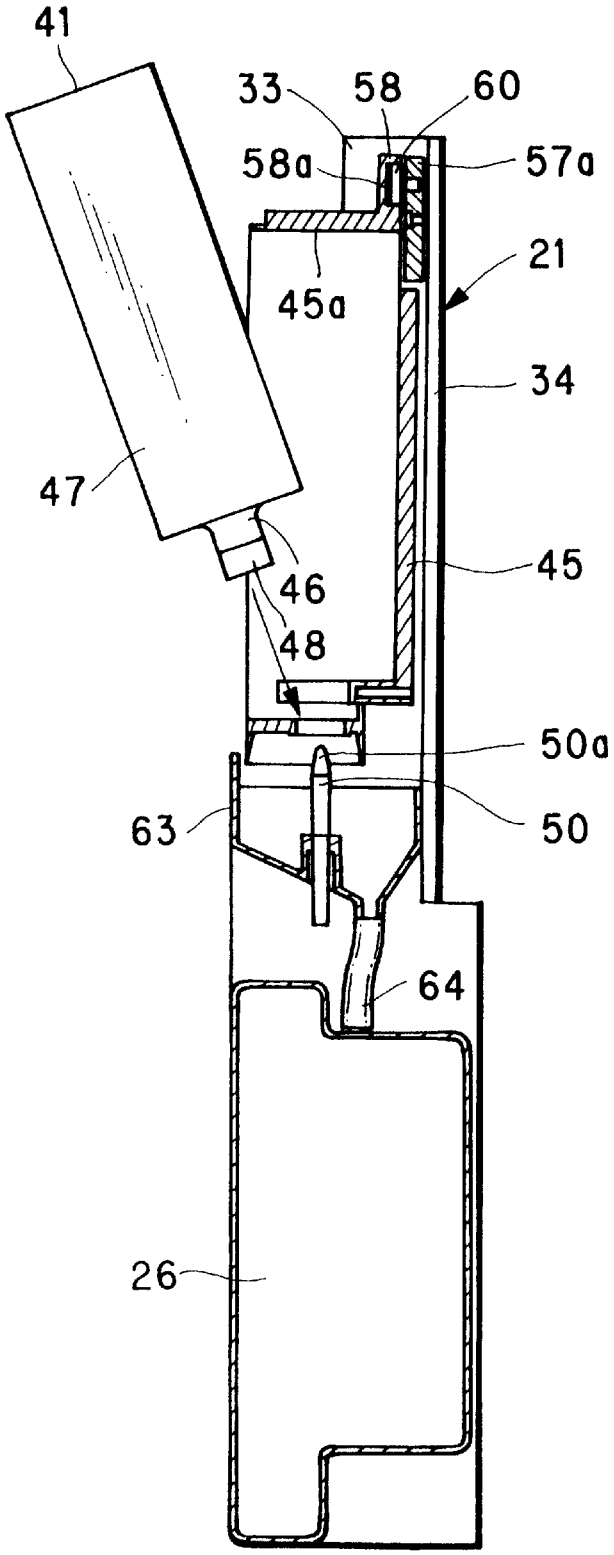
FIG. 5 is a cross section illustrating the replenisher supply device in the course of cartridge loading.
Figure 6:
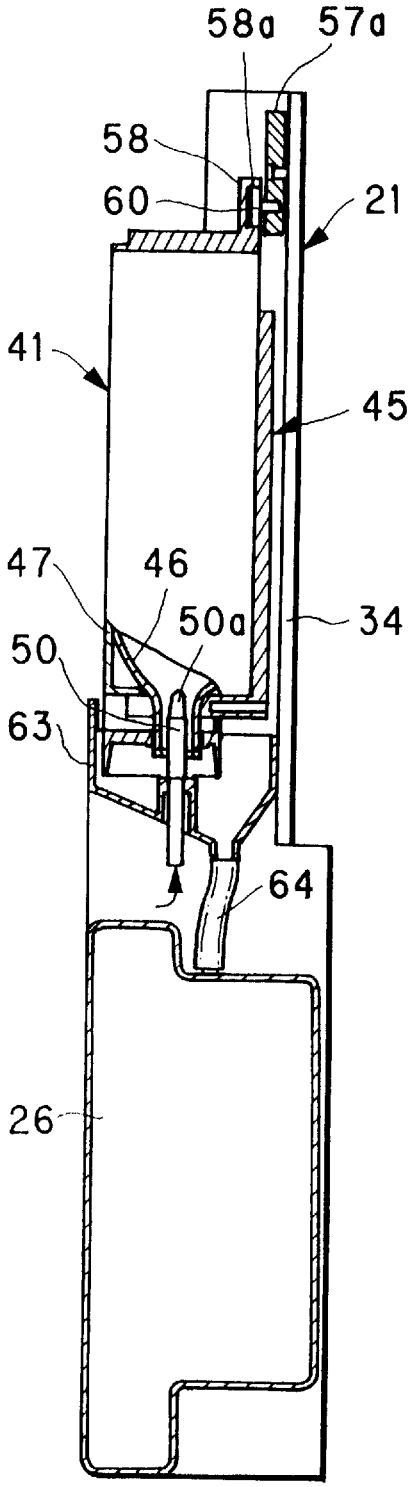
FIG. 6 is a cross section illustrating the replenisher supply device loaded with a cartridge.

The shifter mechanism 55 is constituted by a motor unit 56, a train of gears 57 and an engaging portion 58. The gear train 57 includes a speed reduction mechanism. The engaging portion 58 is disposed on the cartridge holder frame 45. Two transmission gears 57*a* and 57*b* in the gear train 57 have a cam follower 60, which is engaged with the engaging portion 58 of the cartridge holder frame 45. The engaging portion 58 includes an engaging slot 58*a* extending horizontally. At each time when the transmission gears 57*a* and 57*b* are rotated by 180 degrees by the motor unit 56, the cartridge holder frame 45 moves up or down. In FIG. 5, the cartridge holder frame 45 is moved in an upper position so that setting of the replenisher cartridge kit 41 is allowed. In FIG. 6, the cartridge holder frame 45 is moved in a lower position so as to push the opener punch 50 into each of the replenisher cartridges 46. The sealing member 48 is torn open, to unstop the exit of the replenisher cartridge 46.

In FIGS. 5 and 6, the cartridge opener 24 having the opener punch 50 is provided with a funnel member 63, from which the opener punch 50 extends upwards. The opener punch 50 has an upper tapered tip. When the cartridge holder frame 45 is shifted down, the opener punch 50 breaks open the sealing member 48 on the replenisher cartridge 46. A liquid supply nozzle 50*a* is disposed in the opener punch 50. A pump (not shown) sends diluting water through the liquid supply nozzle 50*a* after the sealing member 48 is broken open. The diluting water flows into the replenisher cartridge 46 to wash its inside and also to dilute the replenisher down to a predetermined density. It is to be noted that, after diluting, hot air may be caused to flow out of the opener punch 50 to dry the inside of the replenisher cartridge 46 being washed.

The funnel member 63 collects the replenisher liquid, and guides the replenisher liquid of each type into a relevant one of the tanks 26–28. Each one connector pipe 64 is connected between the funnel member 63 and the tanks 26–28. A supplying pump (not shown) is connected with the tanks 26–28. The pump is driven in consideration of the operating state of the photo film processor, to supply each of the processing baths with the replenisher liquid. Each density of the replenisher liquid in the processing bath is maintained constant.

The second supplier component 32 has the cartridge holder 23, the cartridge opener 25 and the tanks 29 and 30, and structurally similar to the first supplier component 31. The replenisher cartridge kit 42 to be set into the cartridge holder assembly 23 includes two cartridges associated with the color developing bath and the bleaching bath, and has a typically small volume. Thus, a cartridge holder frame or bottle kit holder frame 65 and a shifter mechanism 66 are compactly constructed.

The cartridge holder frame 65 is also supported by the guiding rod 51 in a vertically movable manner. The shifter mechanism 66 shifts the cartridge holder frame 65 up and down. When the cartridge holder frame 65 is moved in a lower position, the opener punch 50 is pushed into each of the replenisher cartridges 46 and breaks open the sealing member 48. When the cartridge holder frame 65 is moved in an upper position, setting and exchange of the replenisher cartridge kit 42 is allowed. The replenisher liquid in the replenisher cartridges 46 is sent into the tanks 29 and 30 through a funnel member 67 and a connector pipe 68.

For use of the replenisher supply device, the holder lids 43 and 44 are opened before the replenisher cartridge kits 41 and 42 are set into the cartridge holder frames 45 and 65. Then the holder lids 43 and 44 are closed. The shifter mechanisms 55 and 66 lower the cartridge holder frames 45 and 65. In FIG. 6, the opener punch 50 opens the sealing member 48 to cause the replenisher to flow down into the tank 26. After the operation of breaking open, diluting water is sent through the opener punch 50 and jetted to the inside of the replenisher cartridge 46, which is washed. Also the diluting water dilutes the replenisher and sets it at a desired density.

In the above embodiment, the panel unit 21 is provided with the cartridge holders 22 and 23, the cartridge openers 24 and 25, and the tanks 26–30. Also, the supplying pump can be mounted on the panel unit 21. A water tank for storing the diluting water may be mounted on the panel unit 21. In the above embodiment, the holder lids 43 and 44 on the outer panel 40 in FIG. 4 are opened for the purpose of loading of the replenisher cartridge kits 41 and 42. However, the outer panel 40 may lack the holder lids 43 and 44. The outer panel 40 may be constructed removably for loading and unloading of the replenisher cartridge kits 41 and 42. In the above embodiment, the replenisher cartridge kits 41 and 42 including the plural cartridges 46 are inserted. However, a replenisher supply device can be loaded with each of the replenisher cartridges 46 one by one without collectiveness. In the above embodiment, the replenisher cartridge kit 41 includes the three cartridges 46 with replenisher liquids to be poured into the three downstream baths. The replenisher cartridge kit 42 includes the two cartridges 46 with replenisher liquids to be poured into the two upstream baths. However the number of the replenisher cartridge kits may be changed. The number of the cartridge included in one replenisher cartridge kit may be changed. The combination of the cartridges with each kind of the replenisher liquid may be changed.

In the above embodiment, the structure of the present invention is used in the photo film processor. Furthermore, a photographic paper processor may be provided with the replenisher supply device of the invention. The replenisher material may be any kind of liquid, such as aqueous solution, any chemical solution, water, oil or the like, and liquid in which powder or fine particles are dispersed. Also, the replenisher material may be a great number of solid particles, such as capsules, tablets, powder, balls, and the like.

In the above embodiment, the panel unit or support unit is secured to the body of the processor in a pivotally shiftable manner. However the panel unit or support unit may be slid, rotated, or moved in any suitable manner between the open and closed positions by use of a sliding mechanism, a rotating mechanism and the like.

In the above embodiment, the apparatus has the cartridge openers 24 and 25 for the replenisher cartridges 46. However the replenisher cartridges 46 may be opened by a previous operation prior to the loading, so that the replenisher can be poured into the tanks 26–30 for storing the replenisher liquid. The plural kinds of the replenisher liquid of the replenisher cartridge kits 41 and 42 may be poured simultaneously. In a still simpler structure, each of the replenisher cartridges 46 can be set one by one for individual flow of the replenisher liquid. The cartridge holder frames 45 and 65 may be so constructed as to support the replenisher cartridges 46 only during the flow of the replenisher liquid. If an operator intends to supplement only a small amount of replenisher liquid, he or she may pour the replenisher liquid by manual operation. Thus the cartridge holder frames 45 and 65 may be omitted from the apparatus.

In the above embodiment, the fixing screws are used to secure the panel unit 21 in the closed position. However, a lock mechanism (not shown) may be additionally provided, and lock the panel unit 21 in each of the closed and open positions. Also, a retaining mechanism may be provided for retaining the panel unit 21 by a clicked engagement in order to keep the panel unit 21 from accidentally moving.

Furthermore, the panel unit 21 may be provided with relevant devices, for example a control unit, and signal terminals and/or a display device specified for the maintenance or inspection. This is effective in enhancing suitability for the maintenance.

Also, a waste liquid tank may be mounted on the panel unit 21. The waste liquid tank, when the panel unit 21 is in the closed position for the maintenance, can be operated for discharging the waste liquid. The waste liquid tank may be mounted in a removable manner. Furthermore, an additional space may be formed in the panel unit 21 for the purpose of mounting an extra replenisher cartridge or replenisher bottle.

In the above embodiment, the panel unit 21 is pivotally shiftable in a horizontal direction. However, the hinge connector 35 may be disposed on a top edge of the panel unit 21, so that the panel unit 21 can be swung open in an upward direction. Of course, the hinge connector 35 may be disposed on a bottom edge of the panel unit 21, so that the panel unit 21 can be swung open in a downward direction.

In the above embodiment, the sealing members 48 consist of a film or sheet. Any suitable adhesive agent may be used for attaching the sealing members 48 to the cartridge exit of the replenisher cartridges 46. Of course, the sealing members 48 may be a sticker. Furthermore, a cuttable, flexible stopping member such as a cork member may be inserted in the cartridge exit.

Furthermore, the replenisher cartridges 46 may lack the sealing members 48 or the cartridge exit. The replenisher cartridges 46 may have a sufficiently thin bottom portion, which may be punched by the cartridge openers 24 and 25.

In the above embodiment, the replenisher supply device constitutes a partial element included in the photo film processor. However, a replenisher supply device in the present invention may be a separate component, and may be combined with a photo film processor for the processing operation.

In the above embodiment, the maintenance opening 38 is used for the purpose of maintenance. The term maintenance is herein used for representing operations including an exchange of any of the processor parts, cleaning of any of them, and other operations for administrating the bath component 10*a*. Of course, the panel unit 21 may be opened and moved away from the maintenance opening 38 only for the inspection of the bath component 10*a*.

In the above embodiment, the cartridge holder frames 45 and 65 are shifted toward the opener punch 50. Alternatively, the cartridge holder frames 45 and 65 may be disposed stationary. The opener punch 50 may be advanced toward the cartridge holder frames 45 and 65 by a shifter mechanism for the purpose of unsealing the cartridges.

In the above embodiment, the photo film processor 10 is supplied with liquid. However, the present invention may be used in any technical field in any apparatus which can be supplied with liquid, a great number of solid particles, a combination of liquid and particles, gas with a suitable characteristic, or any material that can be poured and can flow with fluidity.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A replenisher supply device for a photosensitive material processor, said photosensitive material processor including a bath component for containing processing liquid and for processing photosensitive material by use of said processing liquid, and a processor body for containing said bath component, said replenisher supply device comprising:

at least one cartridge holder loadable with at least one replenisher cartridge, wherein said replenisher cartridge contains replenisher material for being added to said processing liquid;

at least one tank, connected with said bath component, for storing said replenisher material having flowed out of said replenisher cartridge;

a maintenance opening formed in said processor body; and a panel, on which said cartridge holder and said tank are mounted, which is secured movably between closed and open positions, wherein said panel, when in said closed position, closes said maintenance opening, and when in said open position, is positioned away from said maintenance opening, for allowing inspection and/or maintenance of said bath component.

2. A replenisher supply device as defined in claim 1, further comprising at least one cartridge opener, mounted on said panel, for opening said replenisher cartridge set in said cartridge holder, for flowing of said replenisher material.

3. A replenisher supply device as defined in claim 2, wherein said replenisher cartridge includes:

a cartridge body for containing said replenisher material, and having a cartridge exit at one end thereof; and a sealing member for closing said cartridge exit, wherein said sealing member is opened by said cartridge opener.

4. A replenisher supply device as defined in claim 3, wherein said cartridge opener is disposed under said cartridge holder, and said tank is disposed under said cartridge opener.

5. A replenisher supply device as defined in claim 3, further comprising a hinge connector for securing said panel to said processor body in a pivotally movable manner.

6. A replenisher supply device as defined in claim 3, wherein said sealing member comprises a film or sheet;

said cartridge opener includes:

an opener punch, disposed on an extension of said cartridge exit away from said cartridge body, for breaking open said sealing member; and a shifter for shifting one of said opener punch and said replenisher cartridge toward another thereof, to push said opener punch into said sealing member, so as to push said sealing member.

7. A replenisher supply device as defined in claim 6, wherein said shifter shifts said replenisher cartridge by shifting said cartridge holder toward said opener punch.

8. A replenisher supply device as defined in claim 6, further comprising:

a funnel member, disposed about said opener punch, for collecting said replenisher material from said cartridge exit; and a connector pipe, connected with said funnel member, for introducing said replenisher material to said tank.

9. A replenisher supply device as defined in claim 6, wherein said cartridge opener further includes a liquid supply nozzle, disposed in said opener punch, for supplying said replenisher cartridge with liquid, to wash said replenisher cartridge and/or to dilute said replenisher material.

10. A replenisher supply device as defined in claim 3, wherein said cartridge holder includes:

a holder chamber for containing said replenisher cartridge; and a cartridge positioning gap, formed in a bottom of said holder chamber, for setting of said end of said cartridge body therein with said cartridge exit positioned downwards.

11. A replenisher supply device as defined in claim 10, wherein said cartridge holder further includes:

a holder opening for loading of said replenisher cartridge into said holder chamber; and a holder lid for closing said holder opening openably.

12. A replenisher supply device as defined in claim 3, wherein said at least one replenisher cartridge is at least three replenisher cartridges arranged within said cartridge holder;

said at least one cartridge opener is at least three cartridge openers; and said at least one tank is at least three tanks.

13. A replenisher supply device as defined in claim 12, wherein said at least three replenisher cartridges constitute one replenisher cartridge kit;

said replenisher cartridge kit includes:

a casing for containing said at least three replenisher cartridges; and an opening, formed in said casing, for positioning said cartridge exit outside said casing.

14. A replenisher supply device as defined in claim 3, wherein said at least one replenisher cartridge is plural replenisher cartridges for containing said replenisher material of kinds different from one another;

said at least one cartridge holder is two cartridge holders.

15. A photosensitive material processor, comprising:

at least one cartridge holder loadable with at least one replenisher cartridge, wherein said replenisher cartridge contains replenisher material;

at least one tank for storing said replenisher material having flowed out of said replenisher cartridge;

a bath component for containing processing liquid and for processing photosensitive material by use of said processing liquid, said processing liquid being supplied with said replenisher material;

a processor body for containing said bath component;

a maintenance opening formed in said processor body; and a panel, on which said cartridge holder and said tank are mounted, which is secured movably between closed and open positions, wherein said panel, when in said closed position, closes said maintenance opening, and when in said open position, is positioned away from said maintenance opening, for allowing inspection and/or maintenance of said bath component.

16. A photosensitive material processor as defined in claim 15, further comprising at least one cartridge opener, mounted on said panel, for opening said replenisher cartridge set in said cartridge holder, for flowing of said replenisher material.

17. A photosensitive material processor as defined in claim 16, wherein said replenisher cartridge includes:

a cartridge body for containing said replenisher material, and having a cartridge exit at one end thereof; and a sealing member for closing said cartridge exit;

wherein said cartridge opener opens said sealing member.

18. A photosensitive material processor as defined in claim 17, further comprising a hinge connector for securing said panel to said processor body in a pivotally movable manner.

* * * * *